252-105 AU 157 EX
4/7/87 OR 4,655,955

United States Patent [19]
Jetcheva et al.

[11] Patent Number: 4,655,955
[45] Date of Patent: Apr. 7, 1987

[54] COMPOSITION CONTAINING FODDER YEAST WASTE FOR SIMULTANEOUS SCOURING OF METAL SURFACES FROM CORROSION PRODUCTS, SCALE & SCORIA

[76] Inventors: Dimka I. Jetcheva, Bl.31-8, Komplex Mladost-I; Todor M. Todorov, Bl.305-1 Komplex Mladost-III; Nedyalka M. Stoichkova, Bl.316-1, Komplex Mladost-III, all of Sofia, Bulgaria

[21] Appl. No.: 820,932

[22] Filed: Jan. 21, 1986

[30] Foreign Application Priority Data

Jan. 25, 1985 [BG] Bulgaria ..... 68469

[51] Int. Cl.[4] ..... C11D 7/54
[52] U.S. Cl. ..... 252/105; 252/82; 252/132; 252/174.19; 252/557; 252/136; 252/142
[58] Field of Search ..... 252/82, 86, 132, 174.19, 252/557, 142, 136, 105

[56] References Cited

U.S. PATENT DOCUMENTS

| | | | |
|---|---|---|---|
| 3,873,728 | 3/1975 | Moore | 71/11 |
| 4,357,254 | 11/1982 | Kapiloff et al. | 252/82 |
| 4,496,470 | 1/1985 | Kapiloff et al. | 252/82 |
| 4,529,450 | 7/1985 | Panayappon | 252/82 |

*Primary Examiner*—Josephine L. Barr
*Attorney, Agent, or Firm*—Karl F. Ross; Herbert Dubno

[57] ABSTRACT

The means for simultaneous scouring of metal surfaces contains a waste product in manufacture of fodder yeast, citric acid, ammonium citrate, aqueous solution of sodium gluconate, sulphonated ricinic oil and an inorganic acid, f.e. sulphuric acid respectively in the following weight ratios: 60 to 95%; 2 to 6%; 0.1 to 10%; 0.0 to 4.0%; 0.0 to 20% and 0.0 to 15%. The waste product from fodder yeast manufacture contains itself 0.06 to 0.1% reducing agents; 0.01 to 0.4% phosphates; 0.2 to 0.4% ammonium sulphate; 0.0 to 0.06% furfurol and 0.0 to 0.1% yeast.

The means for simultaneous scouring of metal surface from corrosion products, scale and scoria is used in metallurgy, machine construction, agriculture, energetics and all fields where there are conditions for metal corrosion.

4 Claims, No Drawings

COMPOSITION CONTAINING FODDER YEAST WASTE FOR SIMULTANEOUS SCOURING OF METAL SURFACES FROM CORROSION PRODUCTS, SCALE & SCORIA

FIELD OF THE INVENTION

The invention relates to a composition for simultaneously scouring metal surfaces from corrosion products, scale and scoria which can be used in metallurgy, machine construction, agriculture, energy generation and in all fields where there are corroded metals and conditions for occurrence of fresh corrosion.

BACKGROUND OF THE INVENTION

It is known to use inorganic acids for eliminating of corrosion products, scale and scoria (Spring: Scouring of Metal Surface; 1964). However they have a negative effect on the health and the environment, attack the metals and cause rapid development of fresh corrosion.

There is also known a composition for scouring surfaces from organic and inorganic impurities which contains an inorganic acid, sodium benzoate and a surfactant Bulgarian Authors Certificate BG 34262. It comprises in addition a product from preliminary hydrolysis of cellulose by the sulphate method, dodecylbenzolsulphonic acid, streptotricynic antibiotic 741(lavendotricyne) produced by strain Actinomyces Lavandulae, sodium tetraborate, ethoxylated alkylphenol with 10 ethylene oxide moieties per molecule and a condensate of naphthalene sulphonic acid with formaldehyde or ethoxylated fatty alcohols with chain length $C_{10}$-$C_{16}$ in the following weight ratios:

- preliminary hydrolysate—95.00 to 85.00
- sodium benzoate—0.20 to 0.50
- dodecylbenzolsulphonic acid—0.40 to 2.50
- lavendotricyne—0.50 to 0.70
- sodium tetraborate—0.40 to 0.50
- ethoxylated alkylphenol with 10 mol/mol ethylene oxide—0.40 to 1.20
- condensate from naphthalene sulphonic acid with formaldehyde or ethoxylated fatty alcohols $C_{10}$-$C_{16}$—0.40 to 2.50
- inorganic acid:phosphoric or sulphuric 2.00 to 5.00

The preliminary hydrolysate, is an aqueous extract at high temperature of wood which is produced by preliminary hydrolysis by the sulphate method in order to obtain cellulose for viscose fibers. It is characterized by the following composition:

- dry residue at 80° C.—60 to 80 g/l; at 105° C.—50 to 80 g/l
- acetic acid—1.5 to 2%
- formic acid—0.2 to 0.5%
- furfural—0.3 to 0.7%
- reducing substances—2.8 to 3.6%
- monosaccharides—1.9 to 3.2%
- dextrin—0.8 to 1.5%
- brominating agents—1.4 to 1.8%

The hydrolysate has a specific weight at 20° C. of 1,015 to 1,035. The disadvantage of this composition as described is its multicomponent nature, the use of some problematic substances and the fact that when washed the cleaned items tend to corrode anew.

OBJECT OF THE INVENTION

The object of the invention is to provide a composition for the simultaneous scouring of metal surfaces from corrosion products, scale and scoria which ensures temporary protection from fresh corrosion has a reduced or minimum negative effect on health and environment, has little tendency to attack and development of fresh corrosion has comparatively few metals or to promote components and is devoid of the problematical components of earlier compositions.

DESCRIPTION OF THE INVENTION

This object is attained by providing a composition for the simultaneous scouring of metal surfaces from corrosion products, scale and scoria which ensure effective protection from fresh corrosion and consists essentially of: Waste product in the manufacture of fodder yeast, aqueous solution of sodium gluconate, citric acid, ammonium citrate, sulphonated ricinic oil, and inorganic acid in the following weight ratio:

- Waste product of fodder yeast—60 to 95%
- citric acid—2 to 6%
- ammonium citrate—0.1 to 10%
- sulphonated ricinic oil—0.0 to 4%
- aqueous solution of sodium gluconate—0.0 to 20%
- inorganic acid—0.0 to 15%

The waste product in the manufacture of fodder yeast contains:

- Reducing agents—0.06 to 0.1%
- phosphates—0.01 to 0.02%
- ammonium sulphate—0.2 to 0.4%
- furfural—0.0 to 0.06%
- yeast—0.0 to 0.1 g/l The ammonium citrate is added as a finished product or is obtained "in situ" by addition of ammonia water.

The composition according to the invention is prepared by mechanical mixing and homogenizing of the components in respective ratios with respect to a volume unity. To a hot solution of the waste product of fodder yeast is added sulphonated ricinic oil, citric acid, ammonium citrate, sodium gluconate, sulphuric acid and the mixture is stirred to complete homogenizing. The composition is manufactured as a concentrate and after diluting with water in a ratio corresponding to the degree of contamination after solution is obtained the working solution. The latter is applied by immersion, jetting or treatment of the processed surface with soaked pads. The composition is effective at ambient temperature but is considerably more active at temperatures 65°-80° C.

The advantages of the invention are as follows:

- prevention of the negative effect on health and environment;
- the metal is not attacked by the composition;
- prevention of fresh corrosion by the formation of a lasting film on the surface that is stable at atmospheric conditions;
- reduced number of utilized components;
- no use is made of problematic components; and
- it consumes a waste product in manufacture of fodder yeast.

The invention is explained more in detail by the following examples while not limiting its scope:

EXAMPLE 1

To 800 ml hot solution of fodder yeast waste product are added 5 ml sulphonated ricinic oil and it is stirred up to clarifying of the solution. Then are added 30 g technical grade citric acid, 20 g ammonium citrate and 5 ml sulphuric acid. The solution thus obtained is diluted with warm water in ratio 1:1. In the ready solution are immersed samples representing tubes manufactured by the rolling process in the metallurgical plant "L. I. Brezhnev" which are covered with scale. The period of immersion lasts 20 min at a temperature of 55° to 65° C. After washing with water at temperature of up to 30° C. we observed no traces of scale at magnifications of 100,400,1000 times.

EXAMPLE 2

To 600 ml hot solution of fodder yeast waste product are added 0.8 g sulphonated ricinic oil, 15 g citric acid, 10 g ammonium acetate, 3 ml sulphuric acid and warm water at a ratio 1:1. In the ready solution is soaked a pad and therewith are rubbed steel plates which are strongly corroded. The corrosion layer falls away and reveals a clean metal surface that does not corrode when left in open air.

EXAMPLE 3

In one of the above described solutions are immersed strongly corroded steel plates. The latter are entirely scoured up to 40 min at temperature of the solution 65°-80° C. When left without any additional treatment they are formed not to corrode during several months.

EXAMPLE 4

In one of the hereabove described solutions is immersed a tube from heated surface of steam-boiler with high pressure. In 45 min at temperature 65°-80° C. the tube is scoured to clean metal surface.

We claim:

1. A composition for simultaneously scouring metal surfaces from corrosion products, scale, scoria, which consists essentially of a waste product from manufacture of fodder yeast, citric acid, ammonium citrate, aqueous solution of sodium gluconate, sulphonated ricinic oil, inorganic acid in the following weight ratios:
   waste product from fodder yeast: 60 to 95%
   citric acid: 2 to 6%
   ammonium citrate: 0.1 to 10%
   sulphonated ricinic oil: 0.0 to 4.0%
   aqueous solution of sodium gluconate: 0.0 to 20%
   inorganic acid: 0.0 to 15%.

2. The composition according to claim 1 wherein the waste product from fodder yeast manufacture contains:
   reducing agents: 0.06 to 0.1%
   phosphates: 0.01 to 0.4%
   ammonium sulphate: 0.2 to 0.4%
   furfural: 0.0 to 0.06%
   yeast: 0.0 to 0.1%.

3. The composition defined in claim 2 in the form of a concentrate dilutable 1:1 with water and consisting essentially of 800 ml of said fodder yeast waste product, 5 ml of sulfonated ricinic oil, 30 g technical grade citric acid, 20 g ammonium citrate and 5 ml of sulfuric acid.

4. The composition defined in claim 2 in the form of a concentrate dilutable 1:1 with water and consisting essentially of 600 ml of said fodder yeast waste product, 0.8 g sulfonated ricinic oil, 15 g citric acid, 10 g ammonium acetate, and 3 ml sulfuric acid.

* * * * *

| Composition (kind) | Temperature °C. | Period h | Metal loss g/m$^2$ | Coefficient of depth |
|---|---|---|---|---|
| According to author's certificate Nr. 34262 - Bulgaria | 96 | 1 | 14.5 | 8.21 |
| Sulphuric acid - 1% | 75 | 1 | 83.9 | 667.35 |
| Phosphoric acid - 1% | 96 | 1 | 19.1 | 126.5 |
| Composition according to invention | 70 | 1 | 2.0 | no data |

UNITED STATES PATENT AND TRADEMARK OFFICE

CERTIFICATE OF CORRECTION

PATENT NO. : 4,655,955

DATED : Apr. 7, 1987

INVENTOR(S) : Dimka Ivanova JETCHEVA, Todor Marinov TODOROV, Nedyalka Minkova STOITCHKOVA It is certified that error appears in the above-identified patent and that said Letters Patent is hereby corrected as shown below:

Before the listing of the inventors, read the designation of the inventors as --[75] --;

Following the listing of inventors, insert:

-- [73] Assignee: I V S D "AVANGARD"
Sofia, Bulgaria --

Signed and Sealed this

Twenty-first Day of July, 1987

*Attest:*

*Attesting Officer*

DONALD J. QUIGG

*Commissioner of Patents and Trademarks*